US006457187B1

(12) United States Patent
Andersson et al.

(10) Patent No.: US 6,457,187 B1
(45) Date of Patent: Oct. 1, 2002

(54) PRESSURIZED WATER CLOSET FLUSHING SYSTEM

(75) Inventors: Sven Eric Andersson, Ferndale, WA (US); Grayson William Hand, Vancouver (CA)

(73) Assignee: Pulf Water Systems Inc., Vancouver (CA)

( * ) Notice: Subject to any disclaimer, the term of this patent is extended or adjusted under 35 U.S.C. 154(b) by 0 days.

(21) Appl. No.: 09/502,399

(22) Filed: Feb. 11, 2000

(51) Int. Cl.[7] ..... E03D 3/10

(52) U.S. Cl. ..... 4/359; 4/354; 4/361; 4/363; 4/380

(58) Field of Search ..... 4/359, 354, 361–334, 4/380; 251/144

(56) References Cited

U.S. PATENT DOCUMENTS

| | | | | |
|---|---|---|---|---|
| 848,951 | A | 4/1907 | Aeppli-Stocker | |
| 3,817,279 | A | 6/1974 | Larson | |
| 3,817,286 | A | 6/1974 | Caron et al. | 4/354 X |
| 3,817,489 | A | 6/1974 | Caron et al. | |
| 3,820,171 | A | 6/1974 | Larson | |
| 3,820,754 | A | 6/1974 | Caron et al. | |
| 4,233,698 | A | 11/1980 | Martin | |
| 4,327,941 | A | 5/1982 | Schoepe | |
| 4,703,653 | A | 11/1987 | Schoepe et al. | |
| 4,984,311 | A | 1/1991 | Basile et al. | |
| 5,005,226 | A | 4/1991 | Basile et al. | |
| 5,115,521 | A | 5/1992 | Adamides | |
| 5,136,732 | A | 8/1992 | Andersson | |
| 5,361,426 | A | 11/1994 | Martin | |
| 5,363,513 | A * | 11/1994 | Blankenburg | 4/354 |
| 5,553,333 | A | 9/1996 | Andersson | |
| 5,742,950 | A | 4/1998 | Chang | |
| 5,848,441 | A | 12/1998 | Smith et al. | |
| 5,970,527 | A | 10/1999 | Martin et al. | 4/361 |

* cited by examiner

*Primary Examiner*—Gregory Huson
*Assistant Examiner*—Kathleen J. Prunner
(74) *Attorney, Agent, or Firm*—Fulwider Patton Lee & Utecht, LLP

(57) ABSTRACT

A pressurized flushing system for discharging liquid into a toilet bowl. The mechanism comprises a sealed container for storing a pre-determined volume of the liquid under pressure having an inlet for connection to a liquid supply source under pressure and an inlet valve to permit liquid flow through the inlet until the pre-determined volume in the sealed container is reached. There is an outlet for discharging liquid under pressure and an outlet valve movable between an open position to permit liquid discharge through the outlet and a closed position to seal the outlet. The outlet valve is urged by internal pressure within the sealed container toward an open position of the outlet when the pre-determined volume of liquid is in the sealed container, however, an actuator normally locks the outlet valve in the closed position against the internal pressure of the container. Operation of the actuator by a user unlocks the outlet valve to permit movement of the outlet valve to the open position.

26 Claims, 16 Drawing Sheets

PRESSURIZED WATER CLOSET FLUSHING SYSTEM

BACKGROUND OF THE INVENTION

1. Field of the Invention

This invention relates generally to a flushing mechanism for use in toilet flushing applications. More particularly, the invention relates to a low water volume, pressurized water closet reservoir.

2. Description of Related Art

A typical flushing system includes a tank connected to a toilet bowl. The tank holds approximately 14 to 16 liters (4 to 6 gallons) of water and is positioned above the level of the bowl. In such a system, flushing of the bowl is achieved by breaking a seal at the bottom of the tank and releasing water contained within the tank. The weight of the water due to gravity generates a high velocity flow that then carries bowl water and waste into the sewer line. In this type of system, the volume of the water from the tank is used to effect the flushing and replenishing of the bowl, and a minimum of three and a half to four gallons of water are typically required to flush the bowl. Because of heightened concern caused by decreasing water supplies and the consequent need for water conservation measures, it has been legislated that for new construction no more than 1.6 gallons can be used to flush a toilet. Therefore, all new toilets are designed for this requirement whether they be the type described above or pressurized design. Gravity type toilets that are limited to a flush volume of only 1.6 gallons tend to perform poorly, and often require double flushing. Therefore, there is a trend to replace gravity-fed water closets with pressurized water closets. These pressurized water closets typically have a pressurized reservoir to hold the flush water, and a valve which is actuated by the user to discharge the pressurized water into the bowl and thereby carry the waste water into the sewer line.

Several of the currently available low water volume toilet flushing mechanisms rely on the use of a pressurized storage tank that is filled with compressed air in addition to the flushing charge of water in order to increase the head pressure of the reduced volume flushing charge.

U.S. Pat. No. 5,136,732 (Anderson) discloses compression of air that is initially at atmospheric pressure within a storage tank when pressurized water (at mains pressure) enters the storage tank. This compressed air assists in the expulsion of the reduced volume flushing charge of water at a high velocity by expanding rapidly when an aperture in the storage tank is open during the flushing phase of a cycle of operation, thereby allowing flushing charge to flow into the toilet bowl.

U.S. Pat. No. 4,233,698 (Martin) discloses a low water volume toilet flushing mechanism in which air is introduced into and compressed within a main storage tank as the flushing charge of water enters the main storage tank. The pressure of the trapped air within the main storage tank pushes the flushing charge out from the main tank during the discharge phase of a cycle of operation.

U.S. Pat. Nos. 4,984,311 and 5,115,521 (Aramides) both disclose a low water volume toilet flushing mechanism that relies on the contraction of a controlled contractible container such as a bellows or elastic bladder or upon the use of a piston spring system to generate the necessary head pressure in order to achieve a suitable velocity in the flushing charge of water.

U.S. Pat. No. 848,951 (Aeppli-Stocker) discloses a fluid metering and dispensing device that relies upon the force exerted by the pressurized fluid being dispensed for biasing the device to a closed position during cycles of actuation, rather than using springs or other mechanical means.

U.S. Pat. No. 5,526,000 (Basile) discloses a flushing mechanism that uses a reduced amount of water that is contained within an elastic bladder which expands to provide pressure.

U.S. Pat. No. 5,848,441 (Smith) discloses a simplified pressure assist toilet flushing mechanism which incorporates a thin-walled pressure tank.

Although pressurized water closets significantly reduce the amount of water used per flush, closets of this type also suffer from several drawbacks. One problem encountered with a pressurized water closet is that, it tends to be mechanically complicated and prone to breakage or leakage. Another problem is that such systems tend to be noisy. In addition, such systems tend not be retrofittable into existing water closets. They must be installed with a special bowl and tank designed for this system which makes them expensive.

U.S. Pat. No. 5,361,428 granted to Martin for "Hydraulically Controlled Pressurized Water Closet Flushing System", U.S. Pat. No. 5,970,527 granted to Martin for "Pressurized Water Closet Flushing System", U.S. Pat. No. 3,817,279 granted to Larson for "Fluid Control Mechanism", U.S. Pat. No. 3,817,286 granted to Caron for "Hydraulic Flush Tank with Improved Seating and Resealing Means", U.S. Pat. No. 3,817,489 granted to Caron for "Hydraulic Flush Tank with Improved Seating and Sealing Means", U.S. Pat. No. 3,820,171 granted to Larson for "Fluid Control Mechanism", U.S. Pat. No. 3,820,754 granted to Caron for "Hydraulic Flush Tank with Improved Seating and Sealing Means" and U.S. Pat. No. 4,233,698 granted to Martin for "Pressure Flush Tank for Toilets", all describe a flushing valve member that is biased downwardly. The flush valve of the present invention is normally biased to the open position and locked in place by a sealing plug. This permits a greatly simplified structure which produces a reliable flushing system.

Thus, there is a need for a pressurized water closet that can be retrofitted into a conventional water closet and that provides a mechanically simple flushing device with reduced or substantially eliminated problems with leakage and breakage that is reliable and quiet and avoids the leakage and breakage problems of the prior art.

SUMMARY OF THE INVENTION

The invention reduces the difficulties and disadvantages of the prior art by providing a simple pressurized water closet flushing system for dispensing a metered amount of water into a toilet bowl. The pressurized container can be manufactured using conventional plastic injection die technology for a relatively low cost and is easily adaptable to the conventional water closet.

Accordingly, the present invention provides a pressurized flushing system for discharging liquid into a toilet bowl comprising:

- a sealed container for storing a pre-determined volume of the liquid under pressure;
- an inlet to the container for connection to a liquid supply source under pressure;
- an inlet valve to permit liquid flow through the inlet until the pre-determined volume in the sealed container is reached;
- an outlet for discharging liquid under pressure;
- an outlet valve movable between an open position to permit liquid discharge through the outlet and a closed position to seal the outlet, the outlet valve being urged by internal pressure within the sealed container toward an open position of the outlet when the pre-determined volume of liquid is in the sealed container; and an actuator that locks the outlet valve in the closed position against the internal pressure of the container whereby operation of the actuator unlocks the outlet valve to permit movement of the outlet valve to the open position.

The flushing system of the present invention provides a secure and simple means for dispensing a metered amount of water into a toilet bowl, thus reducing excessive water usage. In addition, the device has a novel pressure release mechanism which prevents dangerous pressure build-ups within the reservoir. The device is easily installed into most commercially available toilet systems and can generate relatively high pressures for dispensing water into the toilet bowl, particularly in those areas where water conservation is necessary. The previously described problems of many prior art devices are thus reduced considerably or essentially eliminated. In addition, there is another embodiment of the device which can be used as a standalone device without the need for insertion into a water closet reservoir.

BRIEF DESCRIPTION OF THE DRAWINGS

Aspects of the invention are illustrated in the accompanying drawings, in which.

DETAILED DESCRIPTION OF THE PREFERRED EMBODIMENTS

Figure 1:
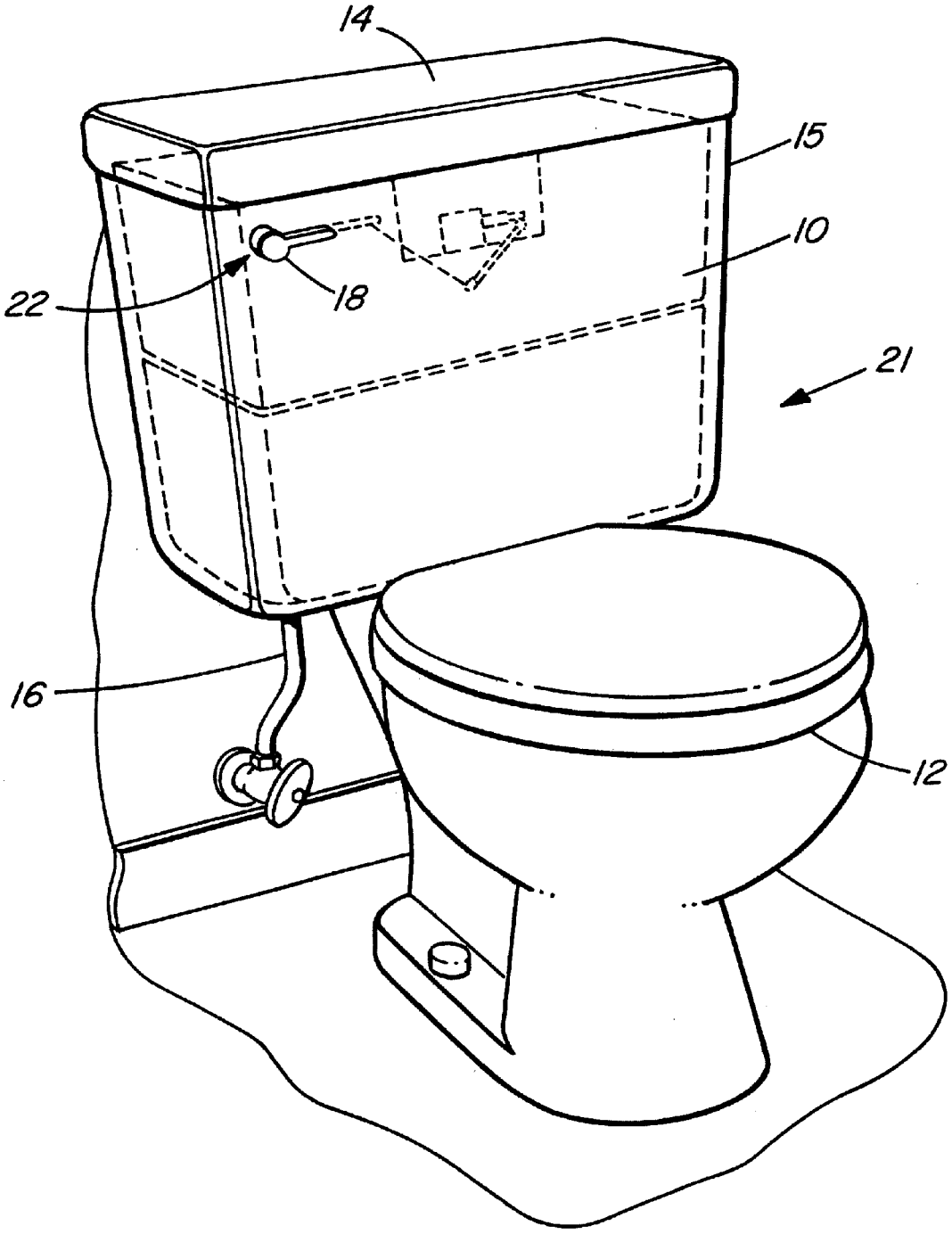
FIG. 1 is a perspective view of the pressurized container of the present invention according to a first embodiment placed in a water closet tank of a conventional toilet system.

Referring to FIG. 1, a sealed container according to a first embodiment of the invention is shown generally at 10 installed in a conventional gravity type toilet 21 of the type currently in use in most residential dwellings. The toilet uses a generally rectangular tank 15 that is positioned above a toilet bowl 12. The tank is enclosed by a removable cover 14 and has a first opening 24 formed at the bottom of the tank (shown in FIG. 2) that allows water to be discharged from the tank 15 into the toilet bowl 12 during a flushing operation. A second sealable opening 26 (shown in FIG. 2*b*) is also formed in the bottom of the tank to receive an inlet line 16 supplying pressurized water, typically from a municipal water supply. Finally, a third opening 22 is formed through a wall of the tank, to pivotally mount a lever 18 for mechanically actuating the flushing operation. Pressurized water entering the sealed container is responsible for increasing the internal pressure of the container.

Advantageously, the sealed container of the present invention can be retrofitted into and operated by the conventional gravity toilet. However, as will become apparent, the instant invention can also be constructed and used independently of existing installations, primarily as a standalone device. Toilets typically use water to effect the flushing of the bowl 12, however, as will be appreciated by one skilled in the art, any liquid designed for sanitary cleansing of a toilet bowl can be used.

Figure 2:
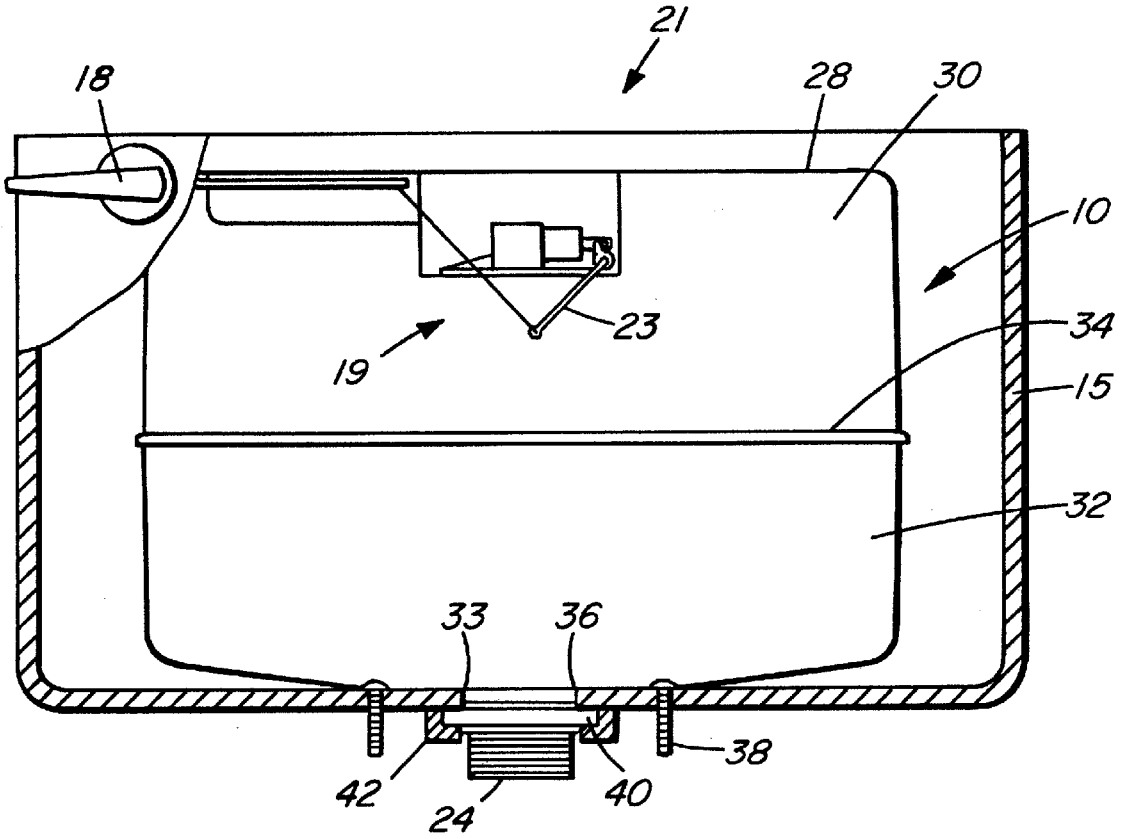
FIG. 2 is a front view of the container shown in FIG. 1 showing the attachment to the tank.
Figure 3:
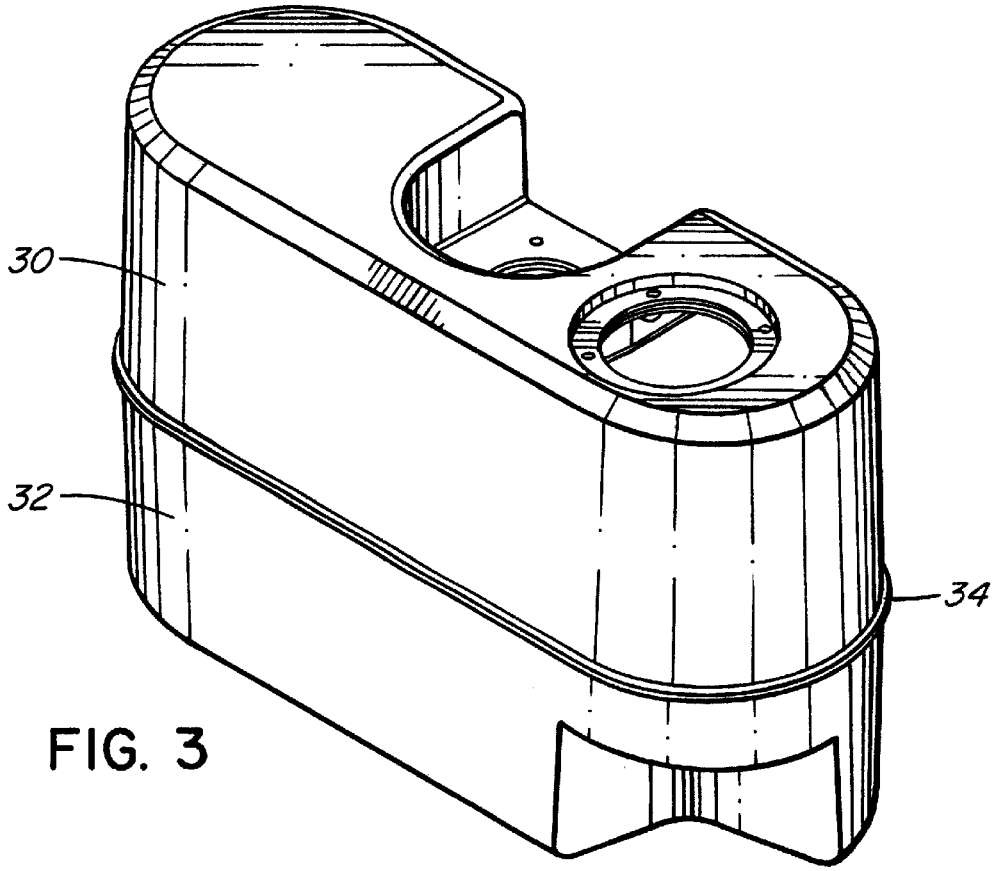
FIG. 3 is a perspective view of the container showing the top and bottom halves connected.
Figure 4:
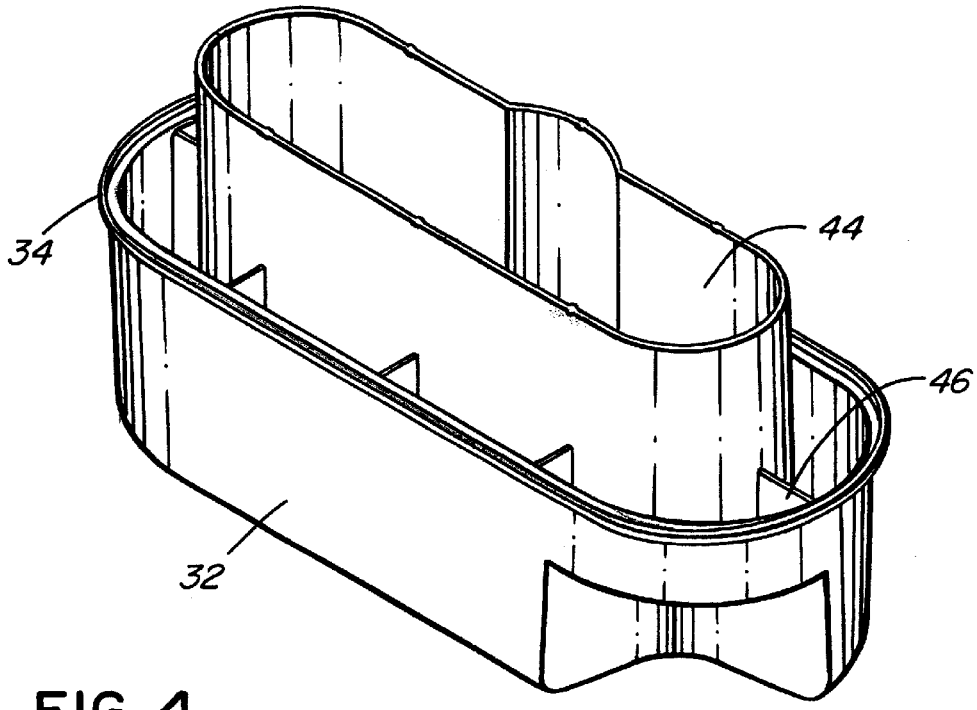
FIG. 4 is a perspective view of the bottom half of the disassembled container.

Referring to FIG. 2, the flushing system of the present invention is shown generally at 20. The flushing system 20 includes a substantially sealed container or reservoir 28, which is dimensioned so that it can be readily inserted in and used with existing water closet tanks. As shown in FIGS. 3 and 4, the reservoir 28 comprises an upper portion 30 and a lower portion 32 that are sealed together beneath an external flange 34. The reservoir 28 of the first embodiment is preferably manufactured using injection moulding or similar techniques, and is typically constructed of a high strength plastic or similar material. As best shown in FIG. 4, the lower portion 32 has an inner water chamber 44 within an outer shell and has ribs 46 between the shell and the chamber that provide rigidity and strength.

The lower portion 32 has an outlet portion 33 that provides a fluid egress from within the chamber 32, through the first opening 24 of the tank and into the bowl 12. As is shown in FIG. 2, the outlet portion 33 is shaped and dimensioned so as to pass through the opening 24 of an existing tank 15. The outer periphery of the outlet portion 33 is threaded, thereby allowing the reservoir 28 to be attached to the existing tank 15 via a tank nut 40. The tank 15 is then fastened to the bowl 12 with bolts 38, and a fluid tight seal is formed by placing a tank gasket safety seal 42 therebetween.

Figure 5:
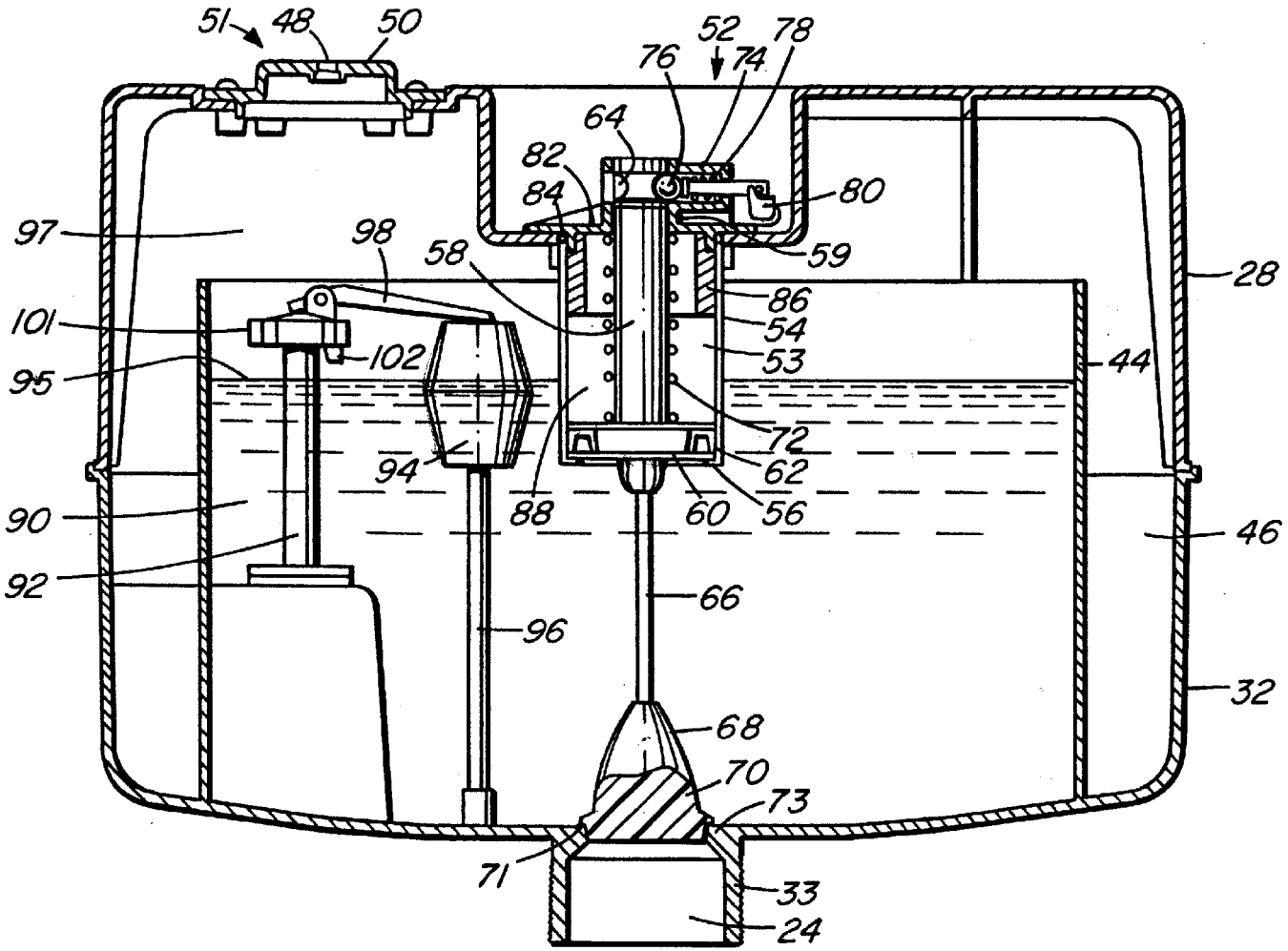
FIG. 5 is a cross-sectional view of the container the tank outlet closed and the container fully charged.
Figure 6:
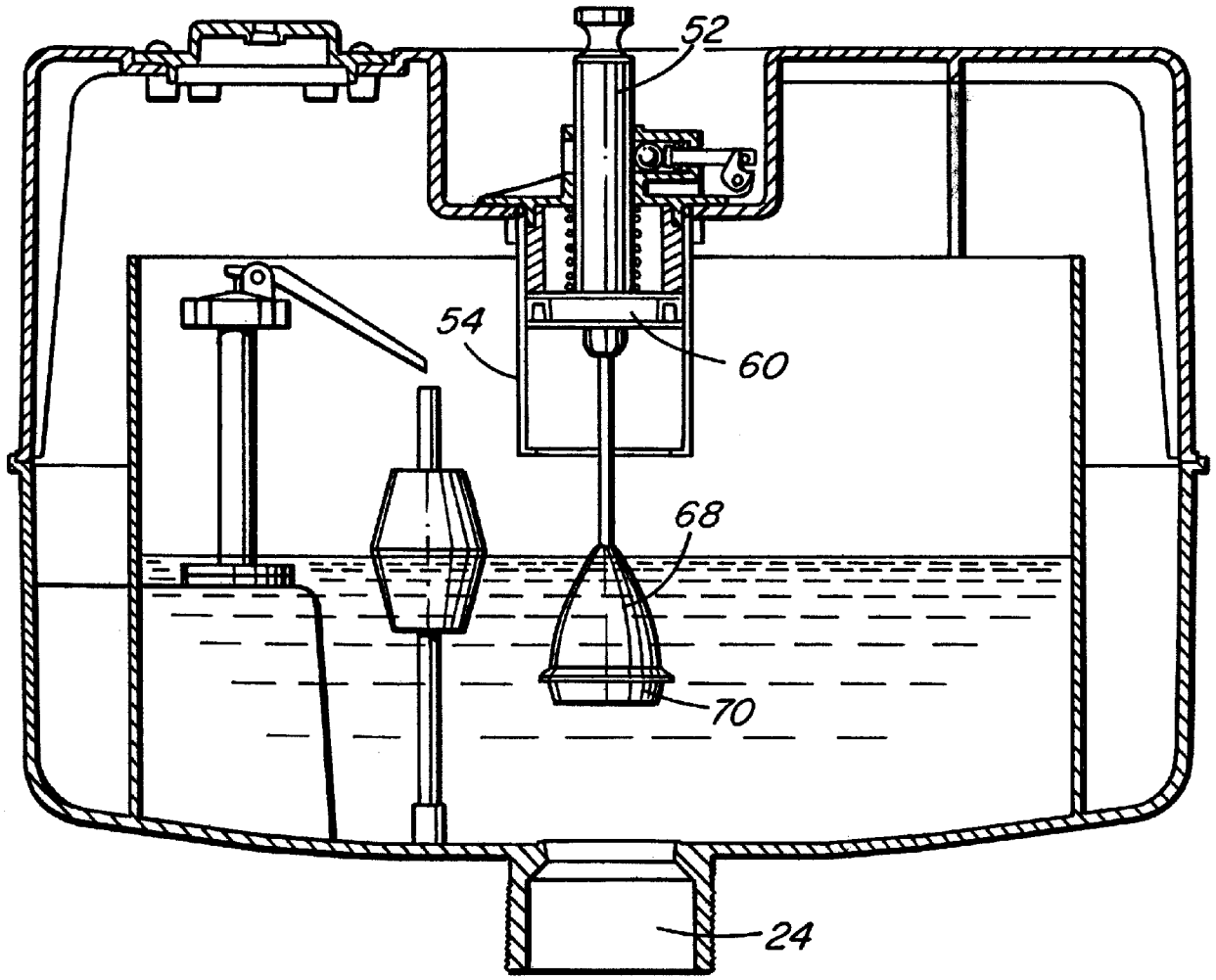
FIG. 6 is a front cross-sectional view showing the tank outlet open and the container discharging water.

Referring now to FIGS. 5 and 6, extending downwardly from the top interior surface of the reservoir 28 is a hollow cylinder 54. The cylinder 54 is positioned in the upper portion of the reservoir 28 directly in line with the outlet portion 33. Movably disposed within the reservoir 28 is an outlet valve 53 for effecting the opening and closing of the fluid egress path defined by the outlet portion 33. The outlet valve 53 comprises a piston 60 having a seal 62 attached thereto and a valve member or sealing plug 68. As can be seen in FIG. 5, the piston 60 is movably mounted within hollow cylinder 54 which guides the piston along a predetermined travel path. The piston 60 is connected to a rigid interconnecting post 66 having a seal 70 mounted at the lower end. The seal 70 is capable of forming a water-tight seal with the outlet portion 33. A sealing lip 71 is provided around the circumference of the seal 70 to ensure a tight seal against a seat 73. The seal 70 is also tapered to further facilitate a good seal. This tapered shape functions as a guide means and helps ensure that the seal portion of plug 68 securely seats in a fluid tight manner within the outlet portion 33. In the non-flushing position, the piston 60 is positioned at the lower end of cylinder 54 in the position shown in FIG. 5 such that the seal 70 seals the outlet and thereby prevents fluid from being discharged into the bowl 12. As best shown in FIG. 6, during a flushing operation, the piston 60 moves upwardly in cylinder 54 so that seal 70 is removed from the outlet portion 33, thereby opening it to fluid discharge so as to effect a flushing of the bowl 12.

Figure 8A:
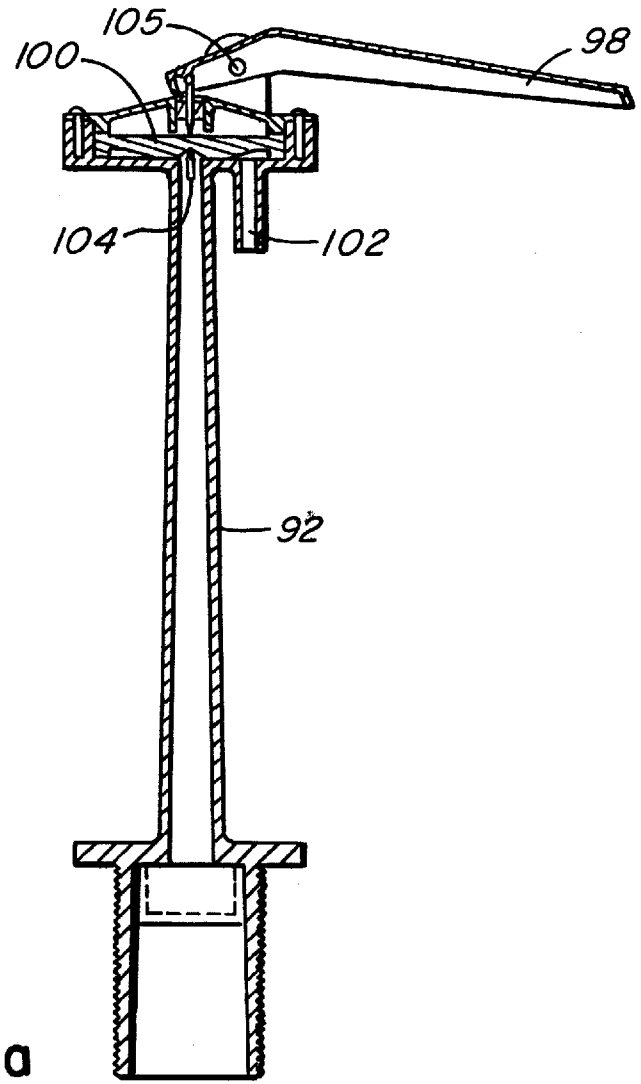
FIG. 8*a* is a cross-sectional view of FIG. 8.
Figure 8:
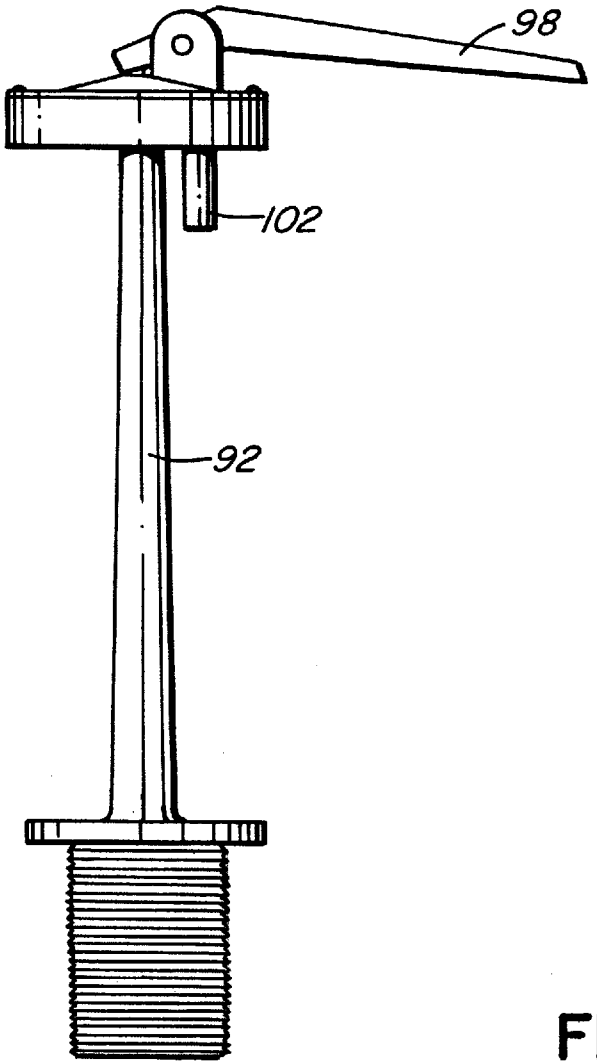
FIG. 8 is a perspective view of the combined fluid inlet and pressure relief system.

As best illustrated in FIGS. 5, 8 and 8*a*, a float valve arrangement 90 comprises a riser pipe 96, a valve cap 101, a float 94, an inlet conduit 92, an outlet conduit 102 and a pivoted arm 98. A seal 100 is mounted over both the inlet conduit 92 and the outlet conduit 102. The seal 100 is moveably attached to the pivoted arm 98 and is anchored by way of a stud 104 that is disposed on the lower end portion of the membrane. Movement of the arm 98 about pivot 105 causes movement in an upward or downward direction of the seal 100. When the seal is positioned over the inlet conduit and the outlet conduit, a watertight seal exists. When the arm 98 is pivoted in a clockwise direction as seen in FIG. 8*a*, the seal 100 is lifted in an upward direction and water enters the conduit 92 and exits the outlet conduit 102 under pressure and is introduced into the reservoir 28. The pressurized water creates a main pressure zone 97 above the water level 95. The amount of water that is introduced into the reservoir is proportional to the pressure that exists in the pressure zone. The water level 95, and therefore the pressure in the pressure zone 97 is regulated by the upward motion of the float 94 that contacts the pivoted arm 98 pivoting the arm in a counter-clockwise direction, thereby pushing the seal 100 in a downward direction and forming a watertight seal over inlet conduit 92 and the outlet conduit 102. The water level is predetermined by the calibrated travel of the float 94. The float valve arrangement also acts as a back-flow prevention device and prevents fluid in the reservoir from re-entering the supply source in the event of negative pressure build-up in the fluid supply line.

Figure 7:
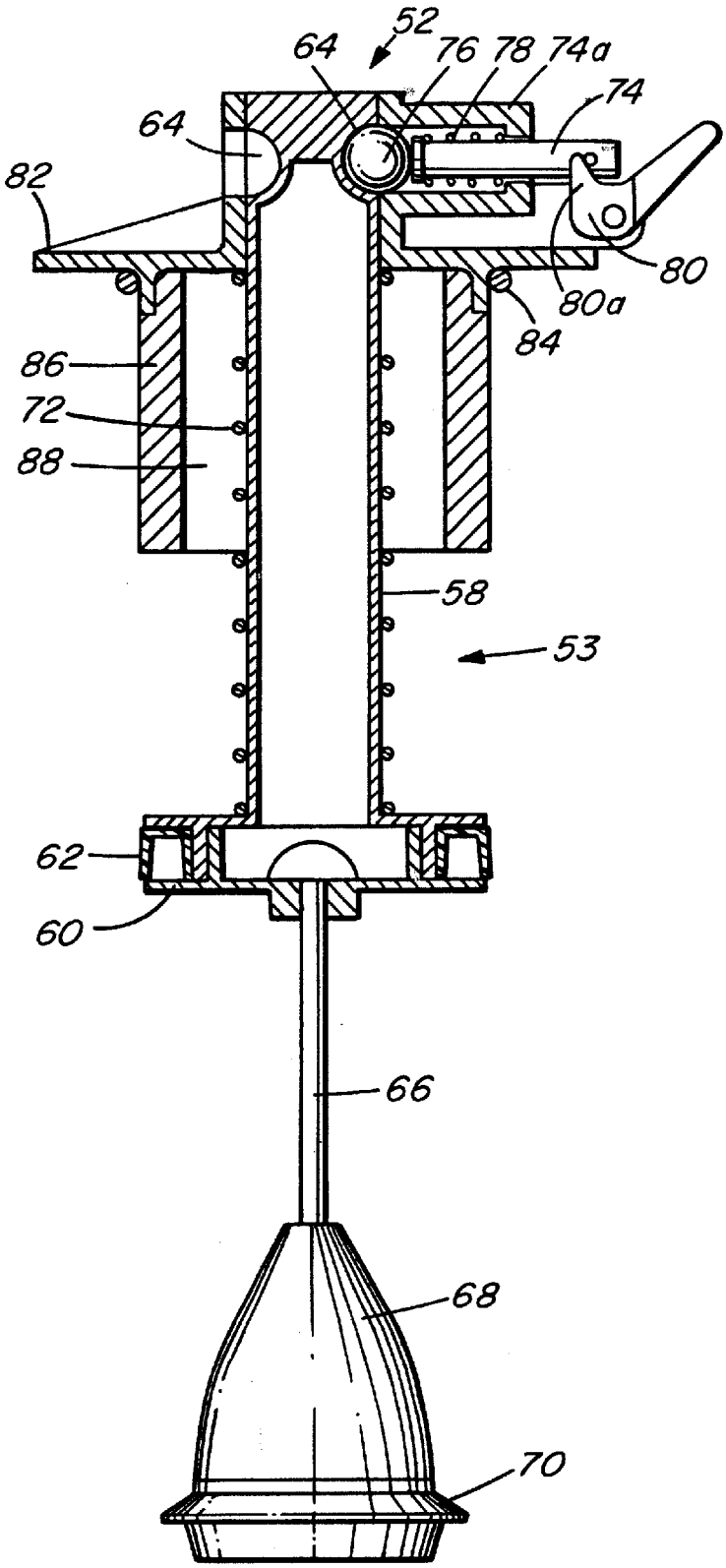
FIG. 7 is a detailed cross-sectional view of the piston assembly with an actuator in place.

Referring again to FIG. 5, the manner in which fluid in the reservoir 28 is discharged through the exit aperture 24 so as to effect a flushing of the bowl 12 will now be described. When not being flushed, the flushing mechanism of the present invention rests in the default position as shown in FIG. 5. Pressurized water entering the sealed reservoir 28 increases the pressure within pressure zone 97 with the result that piston 60 is normally biased upwardly into cylinder 54 by the internal pressure of the container acting on lower surface of the piston. However, piston 60, together with valve member 68, is normally locked into a closed position over outlet 33 by an actuator system 52 as best shown in FIGS. 2, 5 and 7.

Figure 2A:
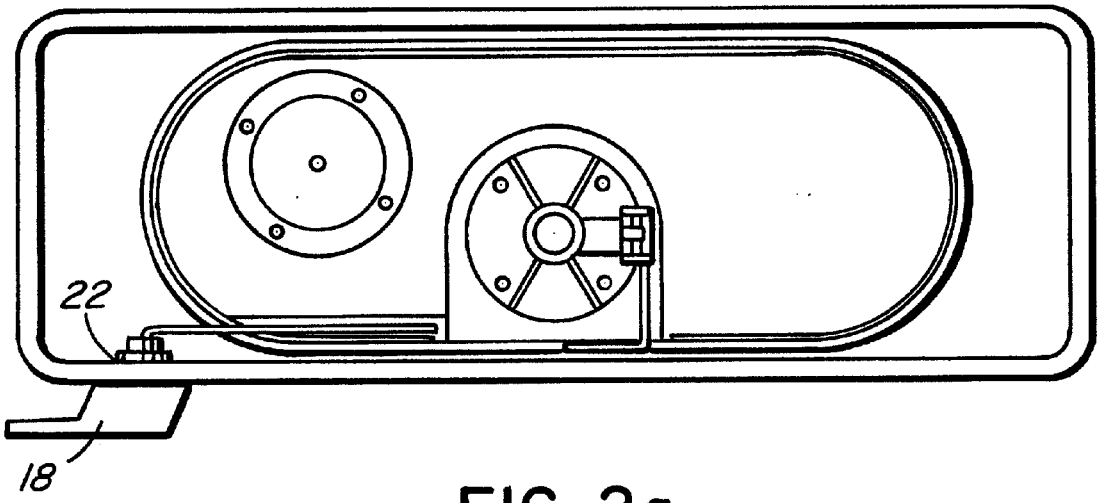
FIG. 2*a* is a top elevation view of the container.
Figure 2B:
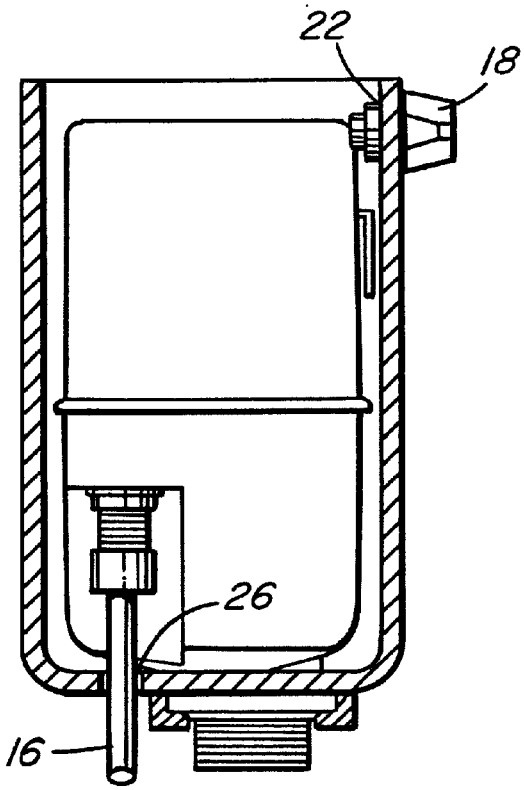
FIG. 2*b* is an end-on view of the first embodiment showing an inlet conduit.

The actuator system 52 preferably comprises a "ball catch" arrangement that engages with piston rod 58 extending upwardly from piston 60. There is a cap 82 that is attached to the top of reservoir 28 over cylinder 54. Cap 82 is sealed in a fluid tight manner by way of a rubber O-ring 84. Cap 82 is formed with a first passage 59 extending upwardly and aligned to slidably receive piston rod 58. Rod 58 is formed with an upper annular groove 64 adapted to received locking ball 76. A movable locking member in the form of pin 74 is slidably received in a second passage 74*a* extending generally at right angles to first passage 59. Pin 74 applies a force against ball 76 to maintain the ball within groove 64. Pin 74 is biased by spring 78 to apply the necessary force against ball 76. The movement of pin 74 is controlled by actuating lever 80. Lever 80 includes an arm 23 that connects via chain 19 to external flushing handle 18 located on the outside of the tank as best seen in FIGS. 2 and 2*a*.

A flushing operation is started by pushing external handle 18 so that chain 19 causes lever 80 to rotate. As best shown in FIG. 7, this rotation causes extension 80*a* on lever 80 to retract pin 74 in second passage 74*a* against the force of spring 78, allowing ball 76 to move out of the piston rod groove 64. This allows the rod 58 and piston 60 to move upwardly due to the water pressure in pressure zone 97. Piston 60 moves upwardly until the upper surface of piston 60 abuts the lower end of internal sleeve 86 in cylinder 54. By this upward motion, outlet 33 is opened thereby discharging the pressurized water into the bowl 12. It will be appreciated that in order to function, the force generated by water pressure on piston 60 will have to be greater than the force generated by water pressure on plug 68. This is most readily achieved by ensuring that the exposed surface area of piston 60 is larger than the exposed surface area of plug 68.

Water is introduced into the reservoir 28 via the float valve arrangement as described above. It will be appreciated that the piston 60 must remain in an upwardly disposed position for a time sufficient to permit water to pass through and fill the toilet bowl 12 after the flushing operation. After flushing, gravity moves piston 60 slowly downwardly. Downward movement of piston 60 is also assisted by spring 72 within cylinder 54. As piston 60 descends, a low pressure region in zone 88 within cylinder 54 is created which tends to slow down the movement of the piston to allow the toilet bowl to refill via outlet 33. Zone 88 is normally at atmospheric pressure. Gradually, the pressure in zone 88 increases to atmospheric pressure by movement of air into zone 88 through passages 59 and 74*a*. At this point, piston 60 has descended to the bottom of cylinder 54 such that the piston abuts lip 56. In this position of piston 60, plug 68 seals outlet 33 and water begins to fill the reservoir 28. At the same time, groove 64 in piston rod 58 is now aligned with second passage 74*a* and spring 78 pushes pin 74 to urge ball 76 to engage in to the groove. The result is that piston 60 and plug 68 are again locked into the closed position over outlet 33 until another flushing cycle is initiated. Water will then continue to be introduced into reservoir 28 until the water reaches a level 95 which acts to close float valve system 90 in a manner already described.

Referring to FIG. 5, following a flushing operation, the pressure within the reservoir may go to a negative level, which may affect the proper operation of the system. As such, the flushing system preferably includes a breaker valve 51 for introducing air into the reservoir when a negative pressure exists. The breaker valve 51 is designed to operate in one-way fashion and consists of a diaphragm 50 that will open an aperture 48 formed therein and let air into the reservoir 28 only while a negative pressure exists within the reservoir 28. Once a flushing operation is complete, the piston 60 descends and returns to a fully closed position where plug 68 seals the outlet 33.

To ensure the overall safety and integrity of the flushing system, the actuator system described above also acts as an overpressure protection system to release water within reservoir 28 into the bowl 12 if the pressure within the reservoir ever exceeds a predetermined limit. Preferably, spring 78 is calibrated to compress thereby releasing piston rod 58 if a predetermined maximum pressure is reached in pressure zone 97. Release of piston rod 58 initiates a flush cycle to reduce pressure in the container and the flushing mechanism automatically resets as described above This spring-loaded safety mechanism prevents water from being continuously dispensed. It also ensures that the reservoir is not subjected to dangerously high pressures, and therefore results in a system that is less subject to leaks and for reservoir ruptures.

The first embodiment of the device is shown for use with a conventional water closet, but it can also be used as a self-contained stand-alone device.

Alternatives

Figure 9B:
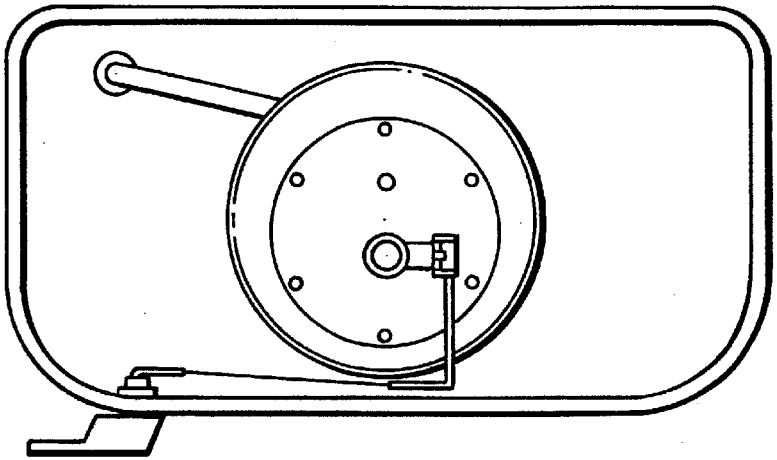
FIG. 9*b* is an end-on view of FIG. 9.
Figure 9:
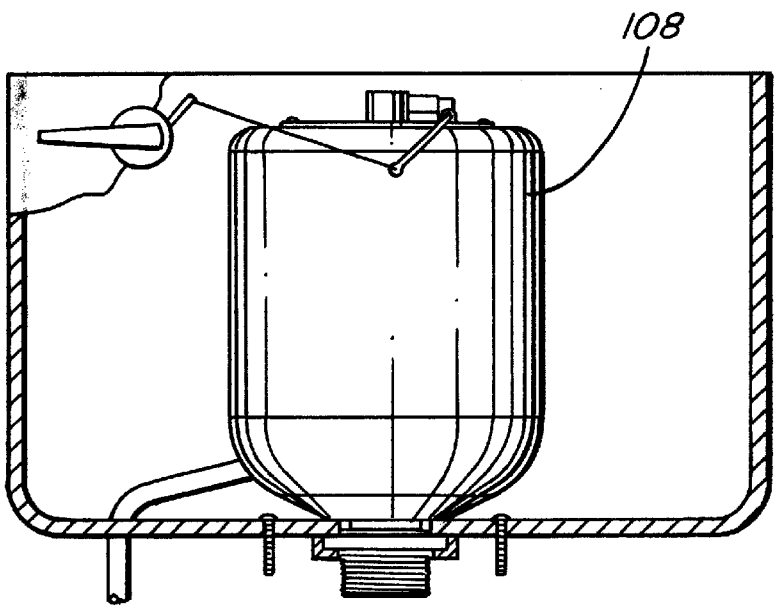
FIG. 9 is a cross-sectional view of a second embodiment attached to a conventional water closet tank.
Figure 9A:
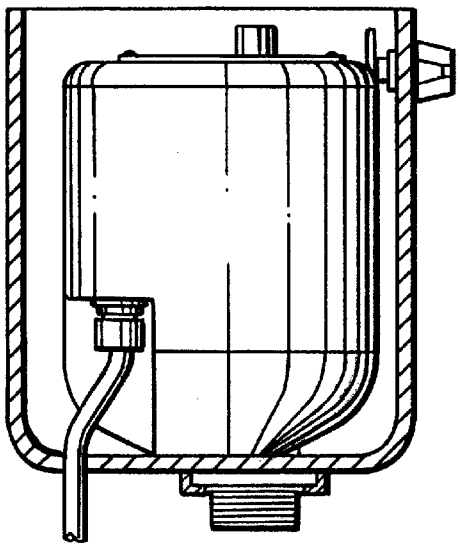
FIG. 9*a* is an elevation view of FIG. 9.
Figure 10:
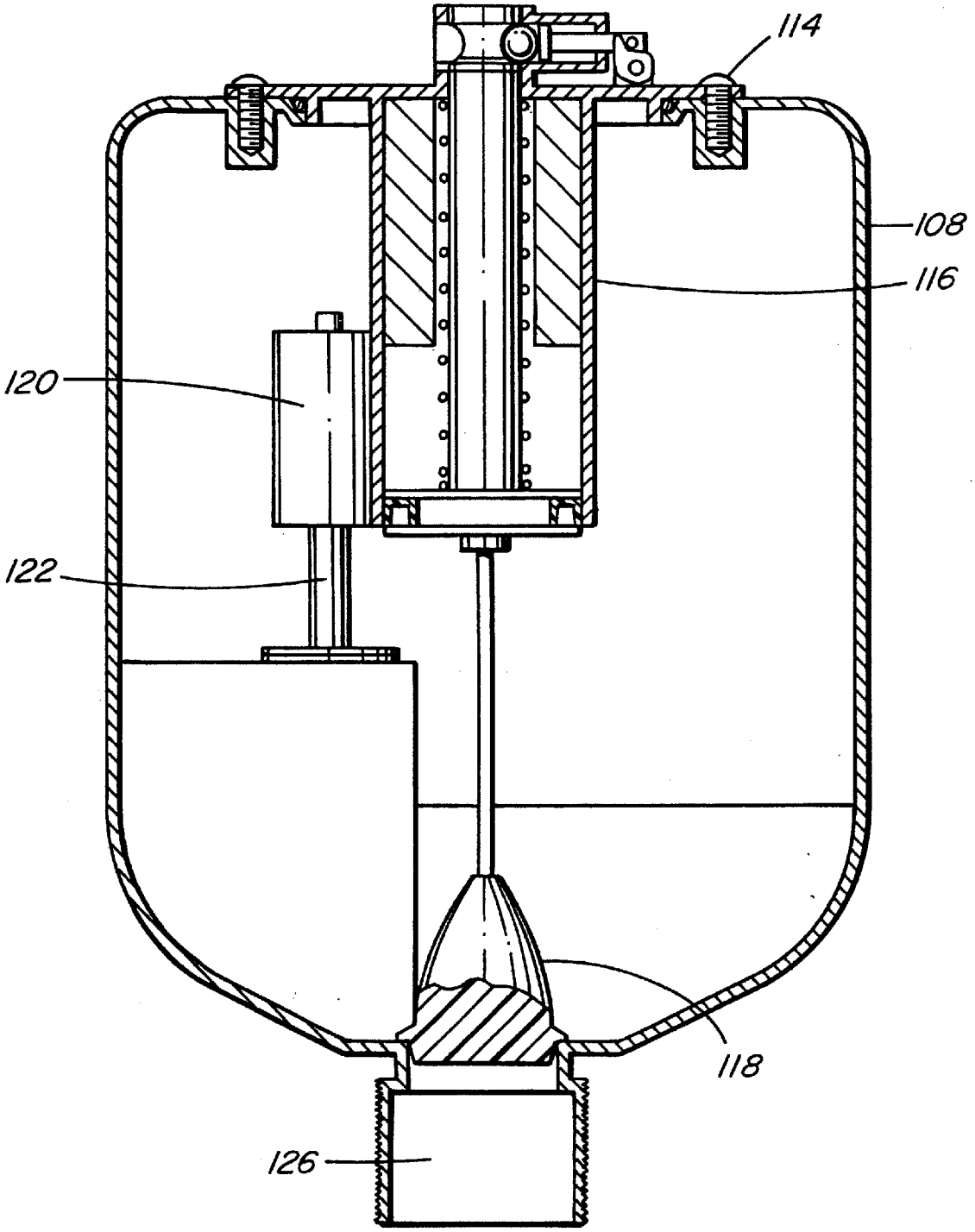
FIG. 10 is a cross-sectional view of FIG. 9.
Figure 11:
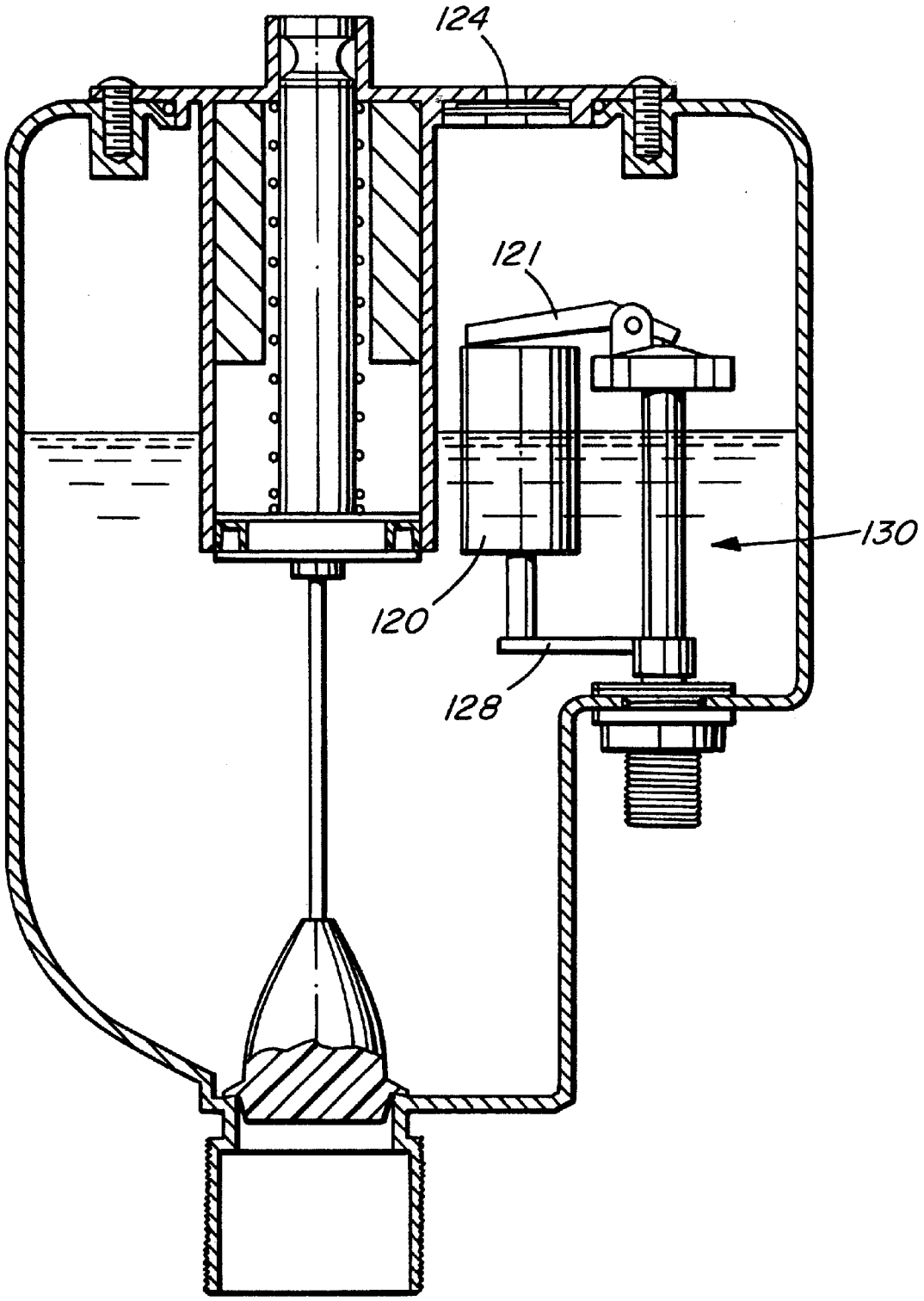
FIG. 11 is a cross section of FIG. 9.

FIGS. 9–11 illustrate a second embodiment of the flushing mechanism of the present invention. The second embodiment includes a reservoir 108, a piston, a piston head and a plug 118 contained within the reservoir. The outlet valve and actuator mechanism are mounted into a single housing 116 for ease of maintenance and repair, otherwise, the components and operation of the second embodiment are essentially identical to the components of the first embodiment. The housing 116 is connected to reservoir 108 by way of bolts 114 that directly screw into the walls of the reservoir and hold the housing and actuator securely in place. A float 120 moveably mounted to a riser pipe 122 and a pivotable arm 121 are interconnected to an inlet pipe as previously described. The float functions in a similar fashion to the first embodiment and the inlet valve system 130 has a similar moveable membrane to control water inlet.

The upper end of the reservoir contains an air inlet valve 124 which functions in a similar fashion to the air inlet valve previously described. In contrast to the first embodiment, however, the reservoir of the second embodiment is not divided into upper and lower portions. The main zone pressure is essentially the head space above the water level. Also, a support 128 connects the float directly to the outside of the inlet pipe. This reduction in components advantageously leads to a second embodiment that is lighter in weight and therefore, more portable.

The operation of the second embodiment is essentially identical to the first in that the second embodiment is activated by the downward motion of the lever which removes the locking ball from the groove in the piston, thereby releasing the piston in an upward motion and dispensing a metered amount of water into the toilet bowl via an exit aperture 126.

A third embodiment of the present invention is shown in FIGS. 12–16 in place within a conventional tank 15. This version of the flushing system uses a blow moulded container 200 and an outlet valve system 202 that is easily removable for replacement or repair.

Container 200 preferably comprises a series of generally vertical aligned cylindrical bodies 204 with each cylindrical body being joined to an adjacent cylindrical body by upper and lower cylindrical passages 206 and 208, respectively. In the illustrated embodiment, there is a middle body that houses the outlet valve assembly 210. As in previous embodiments, there is a water inlet valve 212 connected by pipe 214 to the conventional inlet line 16 of the toilet tank to provide water under pressure to fill container 200. As in the previous embodiment, inlet valve 212 is controlled by a float within container 200 that rises and falls with the level of water in the container.

Figure 13:
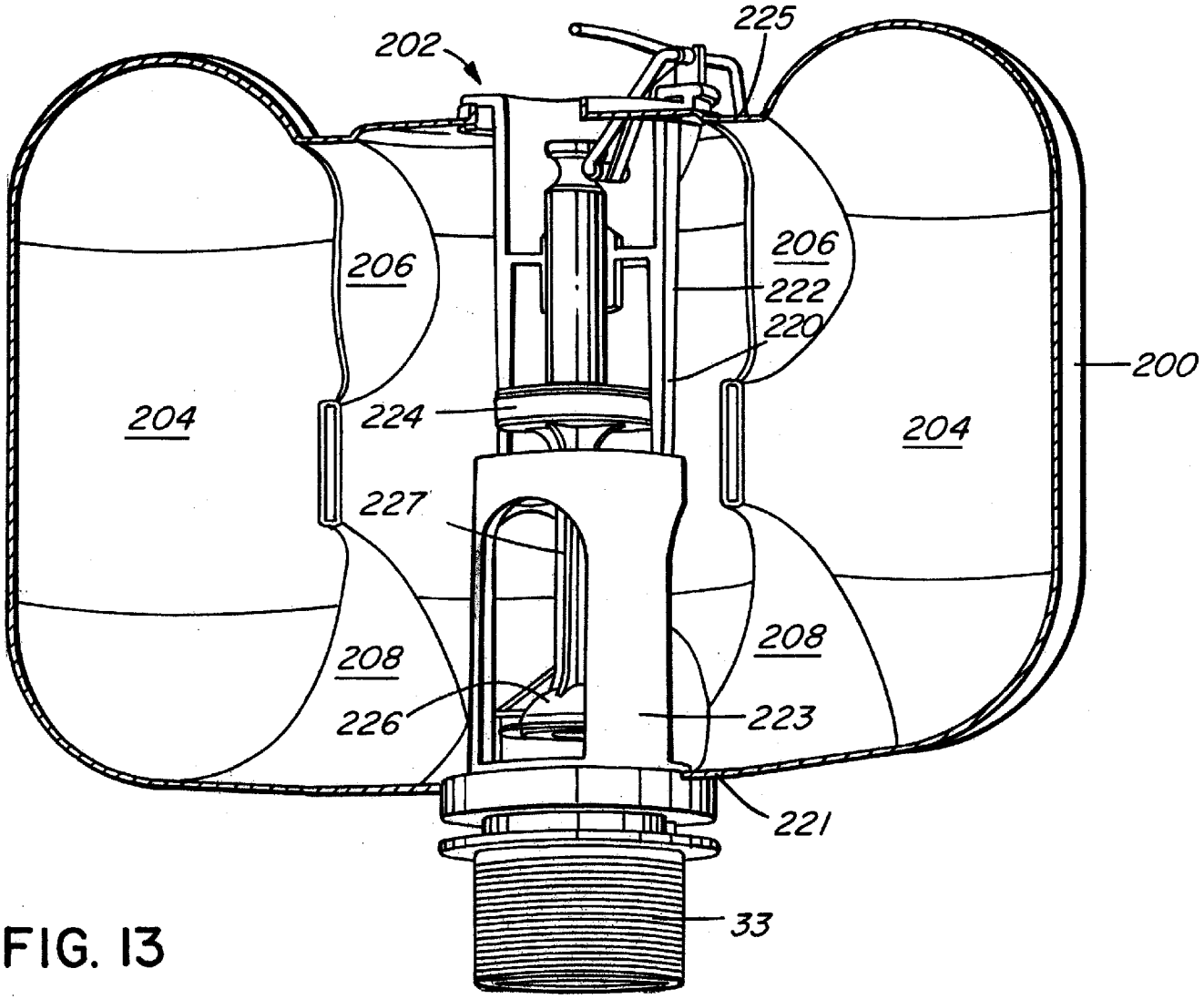
FIG. 13 is a cross-sectional view through the tank of the third embodiment showing the internal details.
Figure 14:
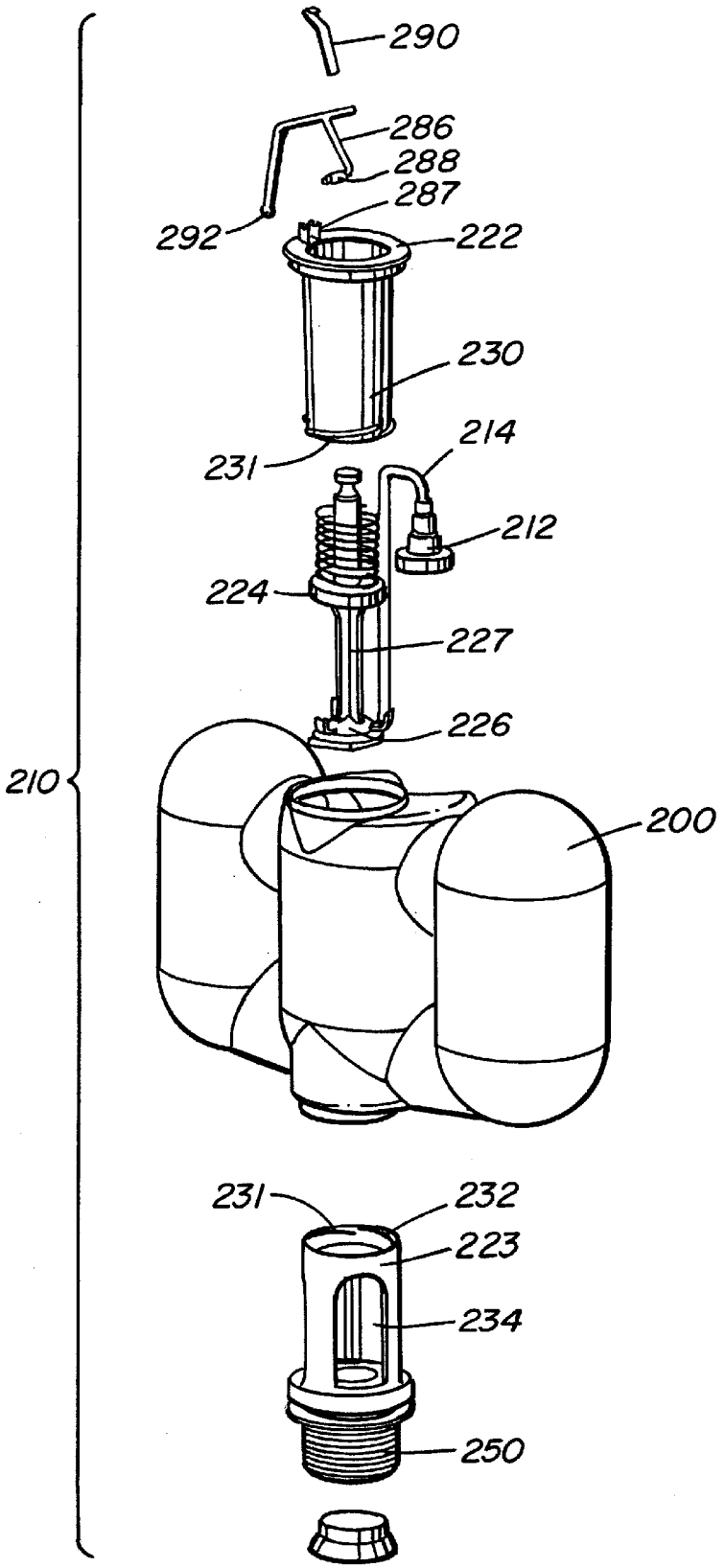
FIG. 14 is an exploded view of the components of the third embodiment.

FIG. 13 is a sectioned view through container 200 showing the internal details of the third embodiment, and in particular, the structure of the outlet valve assembly 202. FIG. 14 is an exploded view of the entire flushing system, and is particularly useful for understanding the components parts of the outlet valve assembly 202 and the manner in which they are assembled.

Referring to FIG. 13, outlet valve assembly 202 comprises a valve housing 220 extending between the walls of container 200, namely the base 221 and the top 225 surfaces of the middle cylindrical body of container 200 to brace the container. To accommodate the valve assembly, these surfaces are flattened unlike the domed end surfaces of the other cylindrical bodies. The domed configuration is the most efficient design for blow molding of container 200 from plastic and makes for the strongest structure.

Valve housing 220 comprises an upper first portion 222 adapted to slidably receive the piston 224 of the valve arrangement. There is a lower second portion 223 adapted to receive valve member 226 that opens and closes outlet 33 in the conventional water tank. As in previous embodiments, piston 224 is connected to valve member 226 by a rigid stem 227 so that valve member 226 moves with the piston.

As best shown in FIG. 14, the lower end 230 of first portion 222 and the upper end 232 of second portion 223 have mutually engageable ends to allow the portions to be releasably interlocked together to define a columnar member with a longitudinal axis extending between the walls of the sealed container. In the illustrated embodiment, the walls of the container comprise base 221 and top surface 225 of the middle cylinder of sealed container 200. In the illustrated embodiment, the ends are formed with cooperating threads 231 that are engaged by inserting first portion 222 into second portion 223 and rotating one portion with respect to the other. Other interlocking arrangements will be readily apparent to a person skilled in the art.

Once interlocked together, the upper and lower portions of valve housing 220 provide a continuous, rigid structure that retains the working parts (piston 224 and valve member 226) of the outlet valve and braces the container 200 against excessive expansion or contraction as pressures fluctuate within the container.

Figure 15:
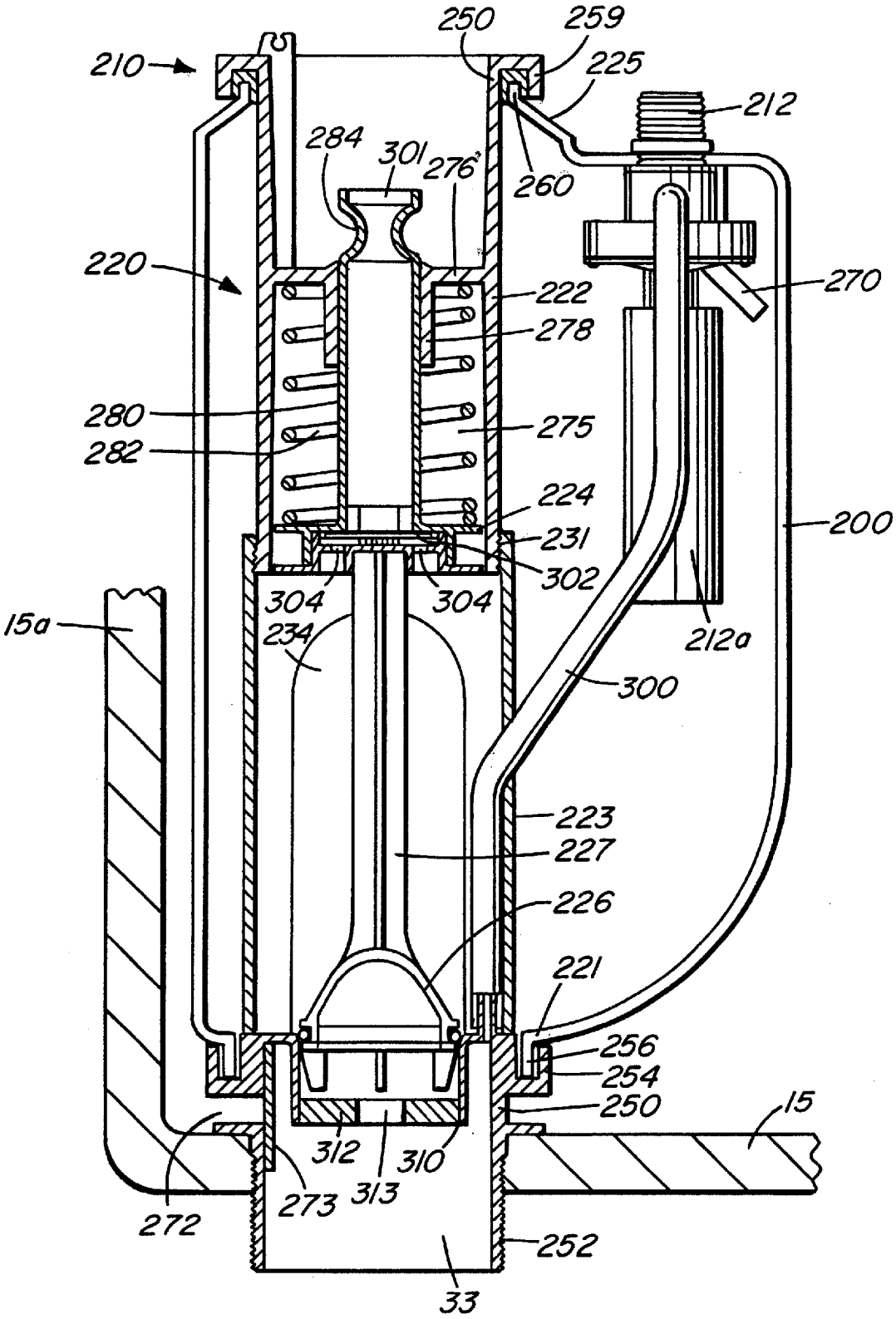
FIG. 15 is a detail section view of the outlet valve in place within the sealed container of the third embodiment.

Referring to FIG. 15, there is shown a detail section view through the outlet valve assembly 210 showing further features of the valve housing 220. Lower portion 223 is a hollow cylinder alignable with the outlet 33 of the sealed container and the tank 15. This alignment often makes it necessary for valve housing 220 to be positioned closer to one wall of container 200 than the other as the outlet of a conventional toilet tank tends to be adjacent the front wall 15*a* of the tank. Lower portion 223 is formed with a plurality of openings 234 therethrough to allow water from container 200 to flow through outlet 33 during a flushing operation.

The lower end of lower portion 223 of the valve housing is formed with a collar 250 to fit through the opening in tank 15 that communicates with the toilet bowl. Collar 250 defines opening 33 for release of water from container 200 to the toilet bowl. Collar 250 has an external threaded portion 252 to receive a nut to lock the collar and the lower portion 223 in place with respect to the tank. The top edge of collar 250 is formed with an upturned annular channel 254 dimensioned to receive a downwardly extending flange 256 about an opening at the base 221 of container 200. The top end 258 of upper valve housing portion 222 is formed with a down-turned annular channel 259 dimensioned to receive an upwardly extending flange 260 about an opening at the top surface 225 of container 200. When the upper and lower portions of the valve housing are engaged with each other, opposed annular channels 259 and 254 cooperate to retain and seal container 200 therebetween, The foregoing arrangement permits ready replacement or repair of the outlet valve assembly. It is simply a matter of reaching into tank 15 to rotate upper portion 222 with respect to lower portion 223 to separate the portions. Upper portion 222 can then be removed through the opening in container 200. Container 200 can then be lifted off annular channel 254 to expose lower portion 223.

Water under pressure enters container 200 through inlet valve 212 as best shown in FIG. 15. Preferably, this water is directed down a wall of container 200 via line 270 to minimize noise. A float 212*a* is suspended beneath valve 212 to monitor the level of water in container 200. As the water level increases, the pressure within container 200 increases. When a pre-determined water level and hence internal pressure is reached, float 212*a* causes inlet valve 212 to shut off. The system is now primed for a flushing cycle.

All water is intended to be retained within container 200. Any minor leakage that may occur or condensation forming on the exterior of container 200 will collect in the bottom of tank 15. Collar 250 is formed with an opening 272 normally sealed by a one-way flap valve 273 to allow any water collected in tank 15 to drain through outlet 33.

The upper portion 222 of the valve housing is a generally cylindrical, hollow member that includes a region 275 sealed from the interior of container 200 by piston 224. Region 275 extends from piston 224 to an upper end wall 276 extending across the diameter of upper portion 222. Upper end wall 276 is formed with a generally vertical, downwardly extending annular flange 278 to define a passage that slidably receives and guides the movement of a piston rod 280 extending upwardly from piston 224. Region 275 houses a coil spring 282 that acts to urge piston 224 downwardly such that valve member 226 seals outlet 33.

As in previous embodiments, piston rod 280 includes an upper annular groove 284 that is engaged by a movable locking member that normally keeps rod 280 and hence piston 224 locked into position against the pressure within container 200 pushing the piston upwardly.

Figure 12:
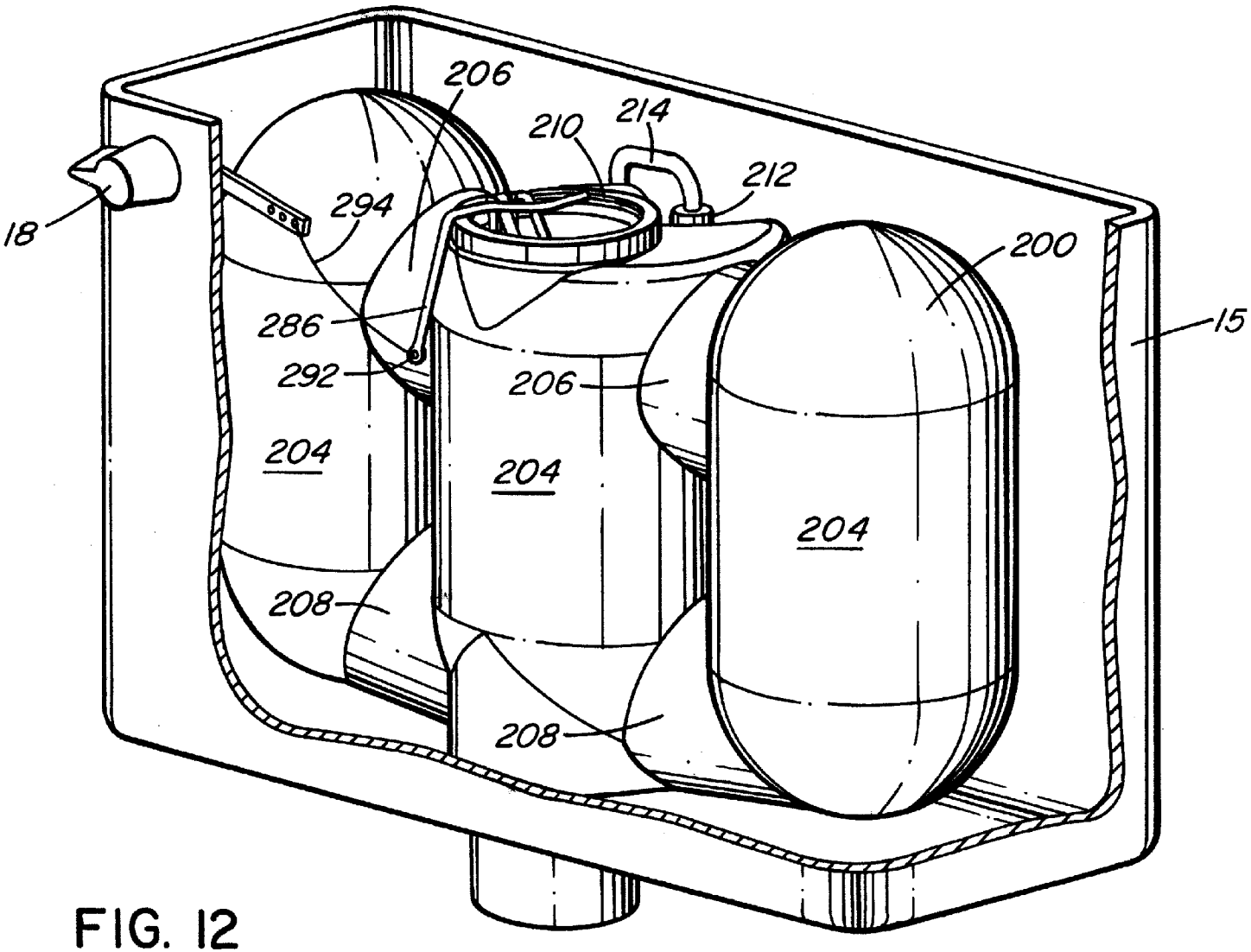
FIG. 12 is a perspective view of a third embodiment of the toilet flushing system of the present invention.
Figure 16:
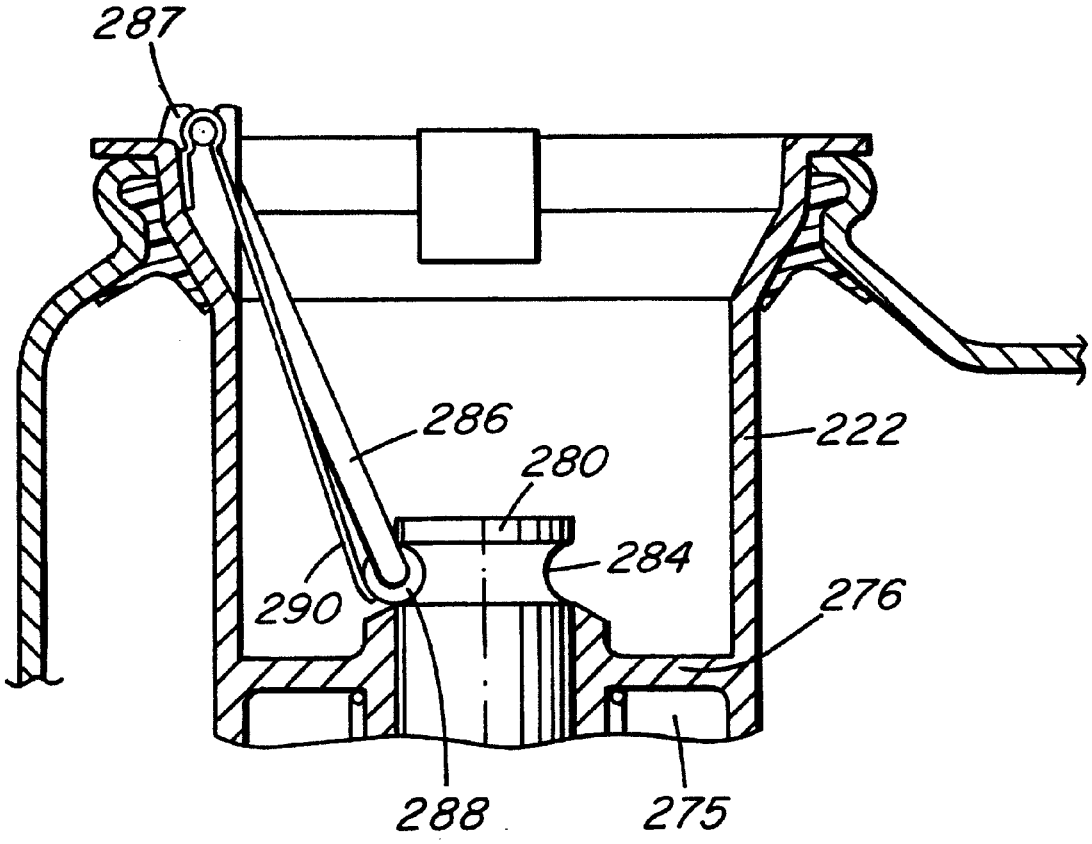
FIG. 16 is a detail view of the actuating mechanism used with the third embodiment.

FIG. 16 provides a detail view with cutaway sections of the top of upper portion 222 of the valve housing and shows a preferred locking member of the present embodiment. The locking member includes a rigid U-shaped arm 286 that is pivotally supported in clip 287 extending from the upper portion 222. The U-shaped configuration of arm 286 is best shown in FIGS. 12 and 14. One end of arm 286 pivotally supports a roller 288 that is dimensioned to fit within groove 284 of piston rod 280. Normally, spring 290 extending from clip 287 biases roller 288 to engage in groove 284 to maintain piston rod 280 in the position illustrated. Referring to FIG. 12, the other end of arm 286 terminates in an opening 292 to receive a chain 294 extending from conventional lever 18 pivotally mounted to the exterior of toilet tank 15. When lever 18 is rotated by a user, arm 286 is rotated against the force of spring 290 out of groove 284 to release piston rod 280 for movement. Due to the internal pressure within container 200, piston 224 is then free to move upwardly within region 275 which is exposed to atmospheric pressure. As in previous embodiments, valve member 226 moves upwardly with piston 224 and outlet 33 is opened so that water under pressure exits container 200 to flush the toilet bowl.

As water leaves container 200, the water level drops rapidly to activate inlet valve 212 to initiate refilling of the container. The initial water entering the container tends to drain through outlet 33 to assist in refilling the toilet bowl. Outlet 33 remains open for a brief period until valve member 226 descends. Referring to FIG. 15, note that inlet valve 212 preferably includes a secondary line 300 that supplies water directly to outlet 33 to provide refill water for the toilet bowl.

Due to gravity and the force of spring 282, piston 224 descends such that valve member 226 again seals outlet 33. Spring 290 biases roller 288 back into groove 284 of piston rod 280 to lock piston 224 in place against the rising pressure in the container. To prevent negative pressures from developing in sealed container 200, piston 224 is formed with a one-way valve. As best shown in FIG. 15, piston rod 280 is hollow and has an open end upper end 301 to define a passage to piston 224. Within piston 224, there is a one-way flap valve 302 that permits air flow from the outside atmosphere into sealed container 200 via passage 304 to raise the pressure if a negative pressure occurs in the container. Otherwise, flap valve 302 acts to seal the container 200 at positive pressures.

The various embodiments of the present invention are intended to be retrofittable onto existing toilets which may not have bowls designed to contain the flow of water under pressure. To avoid splashing, the pressurized flushing system of the present invention can be used with flow limiting inserts to restrict the flow of water from container 200. By way of example, referring to the third embodiment as illustrated in FIG. 15, the end of lower valve housing 223 is formed with a short downwardly directed passage 310 which can be used to locate a flow limiting insert 312 in the form of a disc having an opening 313 therethrough to restrict the flow of water under pressure from container 200 through outlet 33 to the toilet bowl to eliminate unwanted splashing in the toilet bowl.

While specific embodiments of the invention have been described and illustrated, such embodiments should be considered illustrative of the invention only and not as limiting the invention as construed in accordance with the accompanying claims.

We claim:

1. A pressurized flushing system for discharging liquid into a toilet bowl comprising:

a sealed container with walls for storing a pre-determined volume of the liquid under pressure;

an inlet to the container for connection to a liquid supply source under pressure;

an inlet valve to permit liquid flow through the inlet until the pre-determined volume in the scaled container is reached;

an outlet for discharging liquid under pressure;

an outlet valve movable between an open position to permit liquid discharge through the outlet and a closed position to seal the outlet, the outlet valve being urged by internal pressure within the sealed container toward an open position of the outlet when the pre-determined volume of liquid is in the sealed container and the flushing system is in a state ready to be flushed; and an actuator that engages the outlet valve and locks the outlet valve in the closed position against the internal pressure of the container whereby operation of the actuator disengages and unlocks the outlet valve to permit movement of the outlet valve to the open position.

2. A pressurized flushing system as claimed in claim 1 in which the outlet valve comprises:

a piston valve defined by a cylinder extending from a wall of the container with a piston movable within the cylinder, the piston having attached a valve member alignable with the outlet for opening and closing the outlet in response to movement of the piston within the cylinder whereby the internal pressure within the sealed container normally acts on the piston to urge the piston toward the open position of the outlet.

3. A pressurized flushing system as claimed in claim 2 in which the valve member is spaced from the piston by a rigid interconnecting post.

4. A pressurized flushing system as claimed in claim 2 including a spring in the cylinder acting to bias the piston to the closed position of the piston valve.

5. A pressurized flushing system as claimed in claim 2 including a first passage in the sealed container and a piston rod extending from the piston for slidable movement within the first passage to accommodate movement of the piston valve, in which the actuator comprises: a movable locking member introducible into the first passage to prevent movement of the piston rod in the first passage to lock the piston valve in the closed position.

6. A pressurized flushing system as claimed in claim 5 including an actuating lever that is operable by a user to withdraw the movable locking member from the passage and release the piston rod for movement in the first passage to unlock the piston valve for movement to the open position.

7. A pressurized flushing system as claimed in claim 5 in which the container is formed with a second passage that intersects the first passage and the movable locking member comprises a ball movable on the second passage to protrude into the first passage to prevent movement of the piston rod.

8. A pressurized flushing system as claimed in claim 7 in which the piston rod is formed with an annular groove to receive the protruding ball to prevent movement of the piston rod, the annular groove being formed on the piston rod at a location that is aligned with the second passage when the piston valve is in the closed position.

9. A pressurized flushing system as claimed in claim 7 including a pin in the second passage to bias the ball toward the first passage.

10. A pressurized flushing system as claimed in claim 9 including an actuating lever that is operable by a user to retract the pin in the second passage to withdraw the ball from the first passage and release the piston rod for movement in the first passage.

11. A pressurized flushing system as claimed in claim 1 in which the inlet valve is a float valve which automatically shuts off when the liquid reaches a pre-determined level.

12. A pressurized flushing system as claimed in claim 1 in which the sealed container includes an inner region defined by internal walls to retain liquid.

13. A pressurized flushing system as claimed in claim 1 including a pressure breaker valve to prevent negative pressure from developing in the container.

14. A pressurized flushing system as claimed in claim 1 in which the sealed container comprises a series of generally vertical cylindrical bodies with each cylindrical body being joined to adjacent cylindrical bodies by upper and lower cylindrical passages.

15. A pressurized flushing system as claimed in claim 1 in which the outlet valve comprises:

a valve housing extending between the walls of the container to brace the container;

a piston movable within the housing, the piston having an attached valve member alignable with the outlet for opening and closing the outlet in response to movement of the piston within the housing whereby the internal pressure within the sealed container normally acts on the piston to urge the piston toward the open position of the outlet.

16. A pressurized flushing system as claimed in claim 15 in which the valve housing comprises:

a first portion adapted to slidably receive the piston;

a second portion adapted to receive the valve member;

the first and second portions having mutually engageable ends to allow the portions to be releasably interlocked together to define a columnar member with a longitudinal axis extending between the walls of the sealed container.

17. A pressurized flushing system as claimed in claim 16 in which the mutually engageable ends are formed with co-operating threads.

18. A pressurized flushing system as claimed in claim 16 in which the second portion is generally cylindrical and alignable with the outlet of the sealed container, the second portion having openings therethrough to allow water to flow from the sealed container through the openings to the outlet.

19. A pressurized flushing system as claimed in claim 16 in which the first portion is generally cylindrical and includes a region sealed from the interior of the sealed container to receive the piston.

20. A pressurized flushing system as claimed in claim 19 including a spring in the sealed region acting to bias the piston to the closed position of the outlet valve.

21. A pressurized flushing system as claimed in claim 16 in which the piston includes a piston rod, the first portion of the valve housing includes a passage to slidably receive the piston rod to accommodate movement of the piston valve, and the actuator comprises a movable locking member to engage the piston rod to prevent movement of the rod within the passage.

22. A pressurized flushing system as claimed in claim 21 in which the piston rod is formed with a groove and the movable locking member includes a spring biased arm that supports a roller, the spring biased arm urging the roller into the groove to prevent movement of the piston rod.

23. A pressurized flushing system as claimed in claim 22 including an actuating lever operable by a user to rotate the arm to move the roller out of the groove and release the piston rod for movement within the passage.

24. A pressurized flushing system as claimed in claim 15 including a one way valve to prevent negative pressures from developing in the sealed container.

25. A pressurized flushing system as claimed in claim 24 in which the one way valve is formed in the piston.

26. A pressurized flushing system as claimed in claim 1 including an insert removably mountable into the outlet for restricting the flow of water.

* * * * *